US005193746A

United States Patent [19]

Iwamura et al.

[11] Patent Number: 5,193,746

[45] Date of Patent: Mar. 16, 1993

[54] SELF-CLEANING NOZZLE

[75] Inventors: Yoshinari Iwamura, Kobe; Katsunori Okimoto; Akio Shimizu, both of Hiroshima, all of Japan

[73] Assignee: H. Ikeuchi & Co., Ltd., Osaka, Japan

[21] Appl. No.: 761,450

[22] Filed: Sep. 18, 1991

[30] Foreign Application Priority Data

Oct. 26, 1990 [JP] Japan ..... 2-112951[U]

[51] Int. Cl.[5] ..... B05B 15/02

[52] U.S. Cl. ..... 239/109; 239/104; 239/451

[58] Field of Search ..... 239/115, 109, 107, 106, 239/104, 108, 455, 452, 451, 533.1; 222/149

[56] References Cited

FOREIGN PATENT DOCUMENTS 773873 11/1934 France .
2622814 5/1989 France .
581026 8/1958 Italy ..... 239/455
987723 3/1965 United Kingdom .

*Primary Examiner*—Kevin P. Shaver
*Assistant Examiner*—Lesley D. Morris
*Attorney, Agent, or Firm*—Wenderoth, Lind & Ponack

[57] ABSTRACT

A nozzle is disclosed which has a cylindrical nozzle main body. A nozzle tip of the nozzle comprises a plurality of members formed by dividing an approximately cylindrical member in the axial direction thereof and is accommodated in the interior of the nozzle main body. A spring is provided between a spring receiving section of the nozzle tip and a wall positioned on a forward side of the nozzle main body. At least one of a peripheral surface of a discharge section of the nozzle tip and an inner surface of a tip engaging opening of the nozzle main body is tapered. A self-cleaning operation is performed when the atomization pressure is reduced, because the spring urges the nozzle tip toward a rearward side of the nozzle main body.

6 Claims, 12 Drawing Sheets

SELF-CLEANING NOZZLE

BACKGROUND OF THE INVENTION

1. Field of the Invention

The present invention relates to a nozzle and more particularly, to a nozzle having a self-cleaning function of automatically discharging foreign matter which has collected in a fluid path of the nozzle. The nozzle is preferably used to clean a paper making machine because many solid bodies are present in the liquid or fluid used for cleaning. The nozzle is also used as an acid wash nozzle for an iron manufacturing machine.

2. Description of the Related Art

Conventionally, there have been proposed a self-cleaning nozzles as shown in FIG. 28 which automatically discharge foreign matter which has collected in the interior thereof by reducing atomization pressure during a self-cleaning operation.

According to the above-described self-cleaning nozzle, a spray button 3 having a groove 2 formed thereon is fixed to the leading end portion of a nozzle main body 1, a piston 5 slidably provided in the main body 1 is urged by a spring 4 in the direction opposite to the spray button 3, and the end portion of the piston 5 opposite to the spray button 3 is sealed with a flexible diaphragm 6.

In an atomizing operation, the piston 5 is pressed against the spray button 3 against the resilience of the spring 4 by the atomization pressure of liquid or fluid which has been introduced into the nozzle in the direction shown by an arrow (A) (axial direction of nozzle) of FIG. 29, and an injection opening 7 consisting of a slit-shaped orifice is formed by the groove 2 and the leading end of the piston 5 so as to spray liquid or fluid in the direction shown by the arrow (B) approximately perpendicular to the direction shown by the arrow (A).

If foreign matter has collected in the above nozzle and liquid or fluid is prevented from flowing, the atomization pressure is reduced so that the piston 5 is moved backward or to the original position by the spring 4 so as to return the state of the nozzle to the original state as shown in FIG. 28. Thus, the injection opening 7 is opened and as a result, the foreign matter is discharged.

However, according to the above self-cleaning nozzle 11, the injection opening 7 consists of a thin slit-shaped orifice, i.e. the diameter of the path for the flow of liquid or fluid is small. Therefore, compared with other fan-shaped nozzles, foreign matter is likely to collect in the injection opening 7 when a spray operation is performed.

With to the nozzle 11, the liquid introducing direction (direction shown by the arrow (A)) is approximately perpendicular to the atomization direction (direction shown by the arrow (B)). When the nozzle 11 is used by mounting it on a pipe 10 as shown in FIG. 30, the following problems occur.

That is, when the injection opening 7 mounted on the pipe 10 is pointed vertically downwardly as shown in FIGS. 31 and 32, the atomization distribution 12 and the atomization region 13 are symmetrical with respect to the nozzle 11 as shown in FIG. 33. But when the injection opening 7 is not pointed vertically downwardly as shown in FIGS. 34 and 35, the atomization region 13 is dislocated as shown in FIG. 36 and the atomization distribution 12 is not symmetrical with respect to the nozzle 11.

In addition, when a plurality of the nozzles 11 are mounted on the pipe 10 spaced from one another at regular intervals to spray liquid to cover a long distance as shown in FIG. 37, atomization patterns 14 of the adjacent nozzles 11 overlap with each other, with the result that atomized liquid from one nozzle interferes with that from neighboring nozzles, as denoted by reference symbol 15.

Since the atomization distribution 12 and the atomization region 13 are not symmetrical with respect to the nozzle 11 and the interference 15 of atomization pattern is likely to occur, it is necessary for the nozzle 11 to be positioned accurately. Therefore, as shown in FIG. 30, a parallel threaded portion 16 is provided on the periphery of the nozzle 11 so as to mount the nozzle 11 on the pipe 10 by tightening the parallel threaded portion 16 into threads formed at the surface 10*a* of the pipe 10. The mounting mechanism requires a lock nut 17 for accurate positioning and an O-ring 18 for preventing liquid leakage. Further, it is necessary to flatten the mounting surface 10*a* by flattening the nozzle mounting position of the pipe 10. As described above, according to the conventional nozzle, the number of parts and piping processes increases and moreover, labor for mounting parts on the pipe increases.

SUMMARY OF THE INVENTION

It is therefore an object of the present invention to provide a nozzle which prevents foreign matter from collecting in a fluid path and reliably discharges it in a self-cleaning operation. The self-cleaning operation will occur automatically upon a drop in atomization pressure due to foreign matter collecting in the fluid path. A large diameter fluid path is provided for communicating with an injection opening, to also aid in the prevention of clogging due to foreign matter.

It is another object of the present invention to provide a nozzle which, prevents fluid from being atomized a symmetrically with respect to the nozzle by making the direction in which the nozzle is mounted on a fluid supplying pipe coincide with the atomization direction of the nozzle irrespective of the nozzle mounting direction, and which prevents fluid atomized from one nozzle from interfering with that from other nozzles when a plurality of nozzles are mounted in spaced apart fashion on the pipe.

It is still another object of the present invention to provide a nozzle which eliminates the used for a lock nut for placing the nozzle in position, an O-ring for preventing fluid leakage, and a process for flattening the nozzle mounting surface, and which reduces the number of parts, processes, and installation steps.

In accomplishing these and other objects, there is provided a nozzle according to the present invention comprising: a nozzle main body which is cylindrical and has a fluid inlet provided on a rear side thereof and a tip engaging opening provided on a forward side thereof; and a nozzle tip comprising: a plurality of members formed by dividing an approximately cylindrical member in the axial direction thereof; a discharge section having an injection opening in the forward end of the cylindrical member; and a spring receiving section projecting from the periphery of the rear side of the nozzle tip; the nozzle tip being accommodated in the interior of the nozzle main body with the discharge section slidably engaging the tip engaging opening so that fluid flowing from a fluid inlet is atomized from the injection opening through a fluid path extending along the axis of the nozzle main body; and a spring, provided between the spring receiving section of the nozzle tip and the wall positioned on the forward side of the nozzle main body, for urging the nozzle tip toward the rear side when a self-cleaning operation is performed with the atomization pressure reduced.

In the above construction, at least one of the peripheral surface of the discharge section of the nozzle tip and the inner peripheral surface of the tip engaging opening of the nozzle main body is tapered; and a part of the discharge section of the nozzle tip is engaged by a part of the tip engaging opening during an atomization operation and during the self-cleaning operation in which the nozzle tip moves rearwardly and the members of the nozzle tip move away from each other so as to discharge foreign matter which has penetrated into the fluid path. The nozzle tip is axially divided into a plurality of members such that each member includes a portion of the fluid path.

According to another preferred embodiment, the axis of the nozzle main body coincides with the axis of the fluid path and the injection opening, such that they both extend along the axis of the approximately cylindrical nozzle tip accommodated in the interior of the nozzle main body; and a thread for mounting the nozzle main body on a fluid supply pipe is formed in the periphery of the nozzle main body in such a manner that the thread is positioned on the rear side of the nozzle main body and the axis of the thread coincides with that of the nozzle main body.

According to still another preferred embodiment, the periphery of the discharge section of the spring receiving section is tapered to forcibly open the discharge section when the nozzle tip is moved rearwardly by the resilience (or elasticity) of the spring during the self-cleaning operation. Preferably, the thread portion of the nozzle main body is tapered.

More specifically, the nozzle tip comprises two members formed by dividing an approximately cylindrical member in the axial direction thereof. On the discharge section side of the spring receiving section, the semi-spherical section of the pair of the members is tapered from the periphery thereof to the flat section as an inclined surface which forms a certain angle with the flat surface. Preferably, the peripheral surface of the discharge side and the inner peripheral surface of the tip engaging opening are tapered so that the forward end of the discharge side projects from the nozzle main body when an atomizing operation or a self-cleaning operation is performed.

It is preferable to form a spring inserting opening in the spring receiving section and the nozzle main body so that each end of the spring is nonrotatable and elastic.

A sectionally U-shaped groove is formed in the opening of the nozzle main body into which the retaining ring consisting of an elastic material is inserted so that the nozzle tip urged to move rearwardly by the spring is prevented from falling off the nozzle main body.

Preferably, a sectionally U-shaped packing mounting section is provided on the forward side of the spring receiving section so that a packing mounted around the packing mounting section seals the periphery of the nozzle tip.

With to the nozzle of the above construction, the atomization pressure of fluid which has been introduced from the fluid inlet is greater than the resilience of the spring. Therefore, the discharge section projects from the tip engaging opening and fluid is sprayed from the injection opening in the axial direction of the nozzle.

Upon reduction of the atomization pressure when foreign matter has collected in the fluid path of the nozzle tip, the plurality of members of the nozzle tip move from one another at the discharge section due to the fluid pressure in the fluid path, while the nozzle tip is being moved rearwardly by the spring. As a result, the foreign matter is discharged through the opened injection opening via the nozzle opening.

The plurality of members of the nozzle tip are caused to move smoothly away from each other at the discharge section by providing the spring receiving surface with an incline from the periphery to the center thereof. The nozzle tip can be prevented from rotating with respect to the nozzle main body by inserting each end of the spring into the nozzle main body and the spring inserting opening of the spring surface.

Since the axis of the nozzle main body coincides with the axis of the fluid path and the injection opening and the thread is formed on the periphery of the nozzle main body with the axis of the thread coinciding with that of the above axes, the axial direction of the thread and the injection direction of fluid coincide with each other. Even if the nozzle is not placed accurately on the pipe, the fluid atomizing performance is not greatly affected.

BRIEF DESCRIPTION OF THE INVENTION

These and other objects and features of the present invention will become apparent from the following description taken in conjunction with preferred embodiments thereof with reference to the accompanying drawings, throughout which like parts are designated by like reference numerals, and in which.

DETAILED DESCRIPTION OF THE INVENTION

Figure 1:
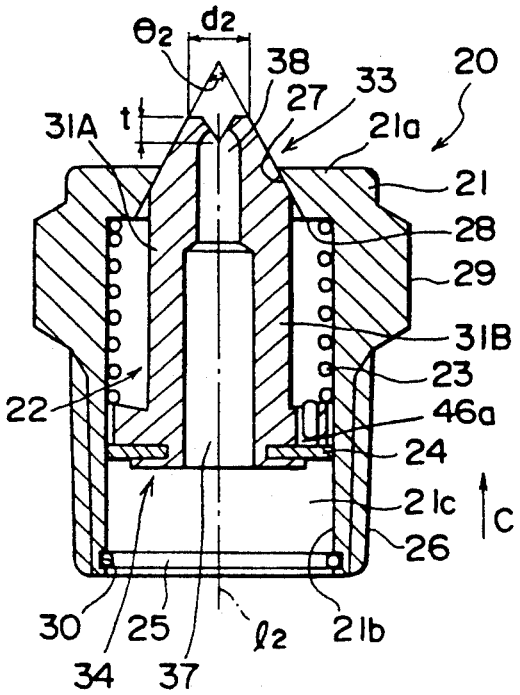
FIG. 1 is a sectional view showing a nozzle according to a first embodiment of the present invention.

Before the description of the present invention proceeds, it is to be noted that like parts are designated by like reference numerals throughout the accompanying drawings.

Figure 2:
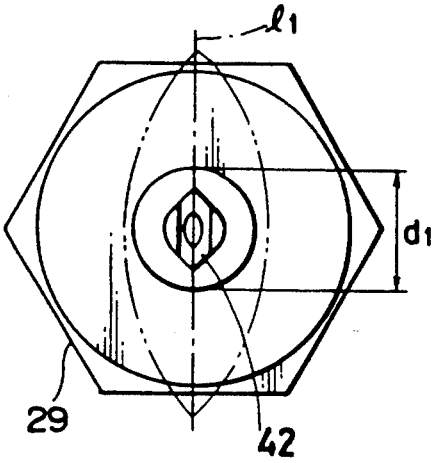
FIG. 2 is a plan view showing the nozzle shown in FIG. 1.
Figure 3:
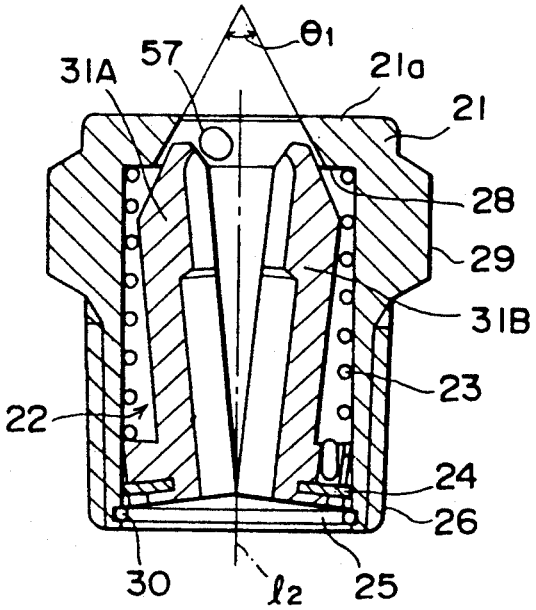
FIG. 3 is a sectional view showing the nozzle shown in FIG. 1 during a self-cleaning operation.
Figure 4:
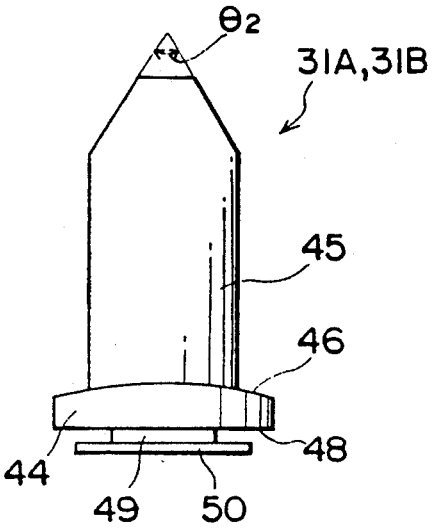
FIG. 4 is a front view showing a member of a nozzle tip.

Referring to FIGS. 1 through 3, a self-cleaning nozzle 20 according to a first embodiment of the present invention comprises a nozzle main body 21, a nozzle tip 22, an elastic spring 23, a packing 24, and a retaining ring 25.

The nozzle main body 21 is cylindrical with its forward end serving as the closed section 21*a* and its other end serving as a fluid inlet 21*b*. The inner diameter of the interior 21*c* of the nozzle main body 21 is uniform along an axis $l_2$. The interior 21*c* accommodates the nozzle tip 22 and the spring 23.

There is provided, in the center of the closed section 21*a* positioned at the forward end of the nozzle main body 21, a tip engaging opening 27 tapered inwardly from the interior 21*c* of the main body 21 toward the exterior thereof. The cone angle $\theta_1$ of the opening 27 and the diameter $d_1$ of the opening 27 at the forward end of the nozzle main body 21 are set to correspond to the cone angle $\theta_2$ of the discharge section 33 of the nozzle tip 22 and its diameter $d_2$ at the forward end thereof which will be described later. Thus, the discharge section 33 can be fixedly inserted into the opening section 27 such that the discharge section 33 projects from the opening 27. The interior 21*c* of the closed section 21*a* serves as a spring carrying section 28 in which one end of the spring 23 is retained. A spring inserting opening (not shown) is formed in the spring carrying section 28 so that one end of the spring 23 is fixedly inserted into the spring inserting opening.

The periphery of the nozzle main body 21 is tapered on the fluid inlet 21*b* side thereof and a tapered threaded portion 26 is formed thereon. A nut section 29 consisting of a hexagon nut is formed on the nozzle main body 21 such that the nut section 21 is positioned on the closed section 21*a* side of the nozzle main body 21.

A sectionally U-shaped groove 30 for accommodating the retaining ring 25 is formed on the nozzle main body 21 such that the groove 30 is positioned on the fluid inlet 21*b* side of the nozzle main body 21.

The approximately cylindrical nozzle tip 22 comprises a pair of semicylindrical members 31A and 31B in contact with each other as shown in FIGS. 4 through 7.

The forward end of the cylindrical section 32 of the nozzle tip 22 is tapered, thus serving as the discharge section 33 and the cone angle thereof is $\theta_2$. A cylindrical spring receiving section 34 is formed about the periphery of the rear end of the cylindrical section 32.

Figure 5:
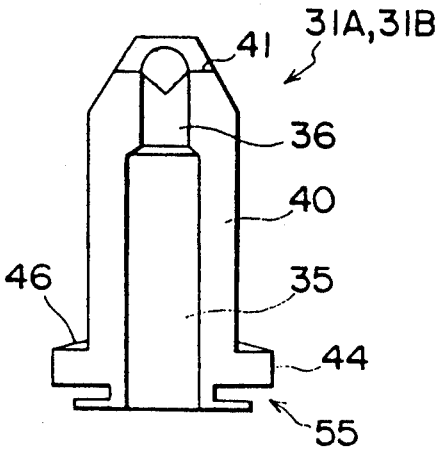
FIG. 5 is a rear elevation showing the member of the nozzle tip shown in FIG. 4.

As shown in FIG. 5, in the nozzle tip 22, a first semicylindrical groove 35 and a second semicylindrical groove 36 which is smaller than the first semicylindrical groove 35 are formed in a flat sections 40 of the pair of members 31A and 31B in contact with each other. As shown in FIG. 1, in the interior of the cylindrical section 32 of the nozzle tip 22, a first fluid path 37 and a second fluid path 38 smaller than the first fluid path 37 in diameter are continuously formed from the rear end of the nozzle main body 21 to the forward end of the discharge section 33 when the pair of members 31A and 31B are brought in contact with each other. That is, the nozzle tip 22 of the first embodiment is divided into the members 31A and 31B along the axis of the nozzle tip 22 so that each member 31A and 31B includes a portion of each of the first and second fluid paths 37 and 38.

Figure 6:
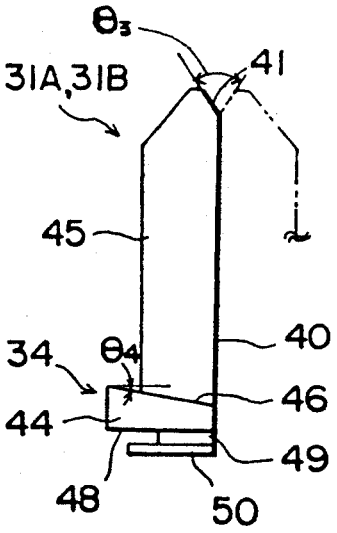
FIG. 6 is a side elevation viewed from the right side of the member of the nozzle tip shown in FIG. 4.
Figure 7:
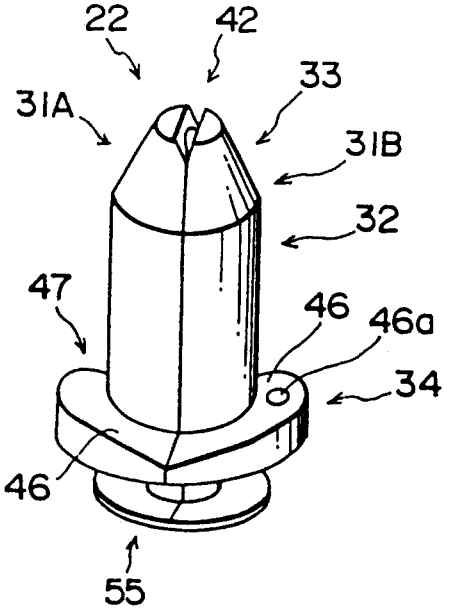
FIG. 7 is a perspective view showing the nozzle tip.

In the discharge section 33, as shown in FIGS. 6 and 7, when the pair of the members 31A and 31B are brought in contact with each other, a notch 41 is formed in the forward end portion of the flat surface 40 of the members 31A and 31B so, as to form a V-shaped injection opening 42 which has a depth (t; see FIG. 1) and a cone angle is $\theta_3$ with $l_2$ being the center line.

On the discharge section 33 side of the spring receiving section 34, as shown in FIG. 6, the semicylindrical section 44 of the pair of the members 31A and 31B is tapered from the periphery thereof to the flat section 40 to form an inclined surface 46 having an angle $\theta_4$ with relative to the flat surface 40. Therefore, on the discharge section 33 side of the spring receiving section 34, a sectionally V-shaped spring receiving surface 47 is formed when the pair of the members 31A and 31B are brought into contact with each one another. A spring inserting opening 46*a* for inserting one end of the spring 23 thereinto is provided on the inclined surface 46 of either the member 31A or the member 31B (the member 31B in this embodiment).

A sectionally U-shaped packing mounting section 55 is provided below the spring receiving section 34. An annular packing 24 is mounted around the packing mounting section 55 so that the periphery of the nozzle tip 22 is sealed by the packing 24. Thus, fluid flows into the first fluid path 37 of the nozzle tip 22 via the fluid inlet 21*b* of the nozzle main body 21.

The spring 23 and the nozzle tip 22 are accommodated in the interior 21*c* of the nozzle main body 21. The spring 23 is interposed between the spring carrying section 28 of the nozzle main body 21 and the spring receiving surface 47 of the nozzle tip 22. As described previously, since the ends of the spring 23 are inserted into the spring fixing opening (not shown) of the spring carrying section 28 and the spring fixing opening 46*a* of the spring receiving surface 47, the spring 23 is incapable of rotating. Therefore, the nozzle tip 22 does not rotate in the nozzle main body 21, thus maintaining the same angular position, namely, the atomizing direction.

The retaining ring 25 consisting of an elastic material is inserted into the groove 30 of the nozzle main body 21. The retaining ring 25 locks the spring receiving section 34 of the nozzle tip 22, thus preventing the nozzle tip 22 urged to move rearwardly by the spring 23 from falling out of fluid inlet 21*b* of the nozzle main body 21.

The operation of the self-cleaning nozzle 20 of the above construction is described below.

In an atomizing operation, fluid is introduced from the fluid inlet 21*b* of the nozzle main body 21 to the first fluid path 37 and the second fluid path 38 of the nozzle tip 22 in the direction shown by the arrow (C) of FIG. 1. As a result, the nozzle tip 22 is pressed toward the direction shown by the arrow (C) of FIG. 1 against the urging force of the spring 23. Consequently, the discharge section 33 of the nozzle tip 22 is inserted into the opening 27 of the nozzle main body 21 in such a condition that the forward end of the nozzle tip 22 projects from the tapered opening 27 as shown in FIG. 1. Thus, fluid is atomized in the direction coinciding with the axis $l_2$ of the nozzle 20, namely, the axial direction of the tapered threaded portion 26.

As described previously, since the injection opening 42 is V-shaped with the cone angle thereof being $\theta_3$ and the depth thereof being (t), the atomization pattern is similar to the configuration of the injection opening 42 as shown by the two-dot chain line of FIG. 2.

Figure 8:
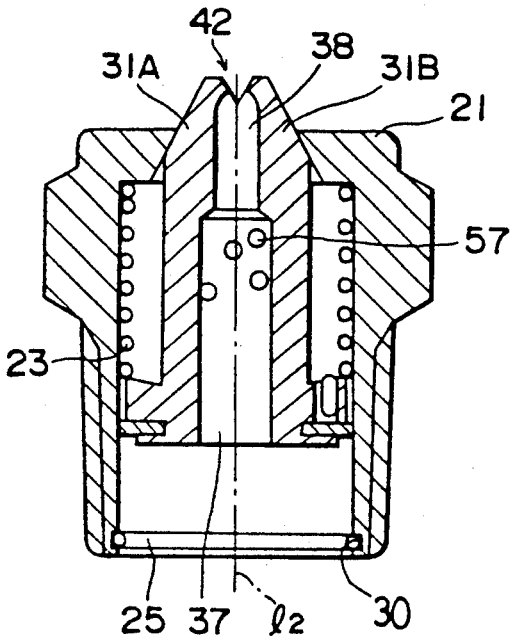
FIG. 8 is a sectional view showing a condition of the nozzle in which foreign matter has penetrated.

As shown in FIG. 8, the nozzle 20 is self-cleaned when, as shown in FIG. 8, the atomizing performance is degraded (i.e., when the flow of the fluid is prevented as a result of the penetration of foreign matter into the first fluid path 37 or the second fluid path 38 such that the foreign matter collects in the first fluid path 37 or the second fluid path 38) to such an extend that the atomization pressure is reduced below the resilience of the spring 23.

During the self-cleaning operation, the nozzle tip 22 is moved rearwardly, or toward the fluid inlet 21*b*, by the spring 23 and as shown in FIG. 3, the members 31A and 31B are separated from one another at the discharge section 33 by the fluid pressure existing in the fluid paths 37 and 38 as the rearward side of the nozzle tip 22 becomes locked by the retaining ring 25.

Therefore, the foreign matter 57 which has collected in the fluid paths 37 and 38 flows out through the opened discharge section 33 via the opening 27 of the nozzle main body 21.

As described previously, according to the first embodiment, since the spring receiving surface 47 of the spring receiving section 34 makes a certain angle with the flat section 40 (or is sectionally V-shaped), the members 31A and 31B move away from one another from the forward end thereof due to the urging force of the spring 23 as shown in FIG. 3. As a result, the injection opening 42 is opened, thereby reliably discharging the foreign matter 57.

Upon an increase in the atomization pressure after the foreign matter 57 is discharged outside, the nozzle tip 22 is again pressed by the fluid pressure in the direction shown by the arrow (C). As described previously, since one end of the discharge section 33 is inserted into the opening 27, the nozzle tip 22 slides along the inner peripheral surface of the tapered opening 27, thus projecting from the tapered opening 27, with the result that the members 31A and 31B are brought into contact with and the nozzle 20 returns to its original state as shown in FIG. 1. Thus, the atomizing operation is resumed.

Since the foreign matter 57 is discharged in the above-described self-cleaning operation the nozzle 20 is capable of continuing the atomizing operation without degrading the atomizing performance by repeating the above-described self-cleaning operation as necessary, or periodically.

The operation of the nozzle 20 which is described below relates to the use of the nozzle 20 by mounting a plurality of the nozzles 20 on a long fluid supplying pipe by spacing them from each other at a certain interval.

Figure 9:
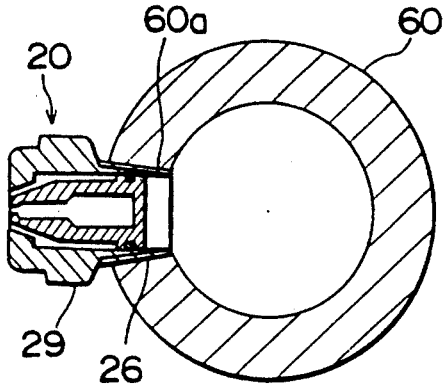
FIG. 9 is a sectional view showing the nozzle of FIG. 1 mounted on a pipe.

In order to mount the nozzle 20 on a pipe 60, as shown in FIG. 9, the tapered threaded portion 26 provided on the periphery of the nozzle main body 21 is tightened into a tapered threaded opening 60*a* formed on the pipe, 60. Since the nozzle 20 is mounted on the pipe 60 with the tapered threaded portion 26, it is unnecessary to use an O-ring to prevent fluid leakage.

Figure 10:
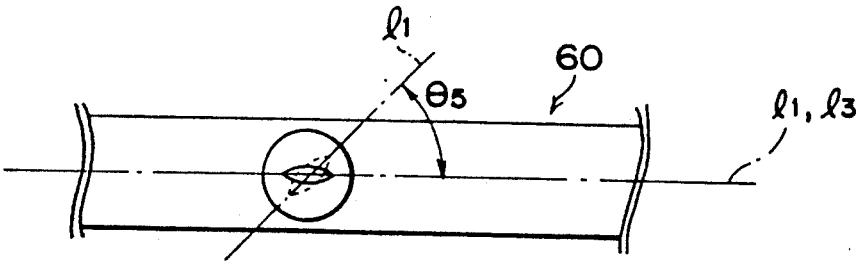
FIG. 10 is a bottom view showing the nozzle of FIG. 1 mounted on the pipe at a predetermined angle.
Figure 11:
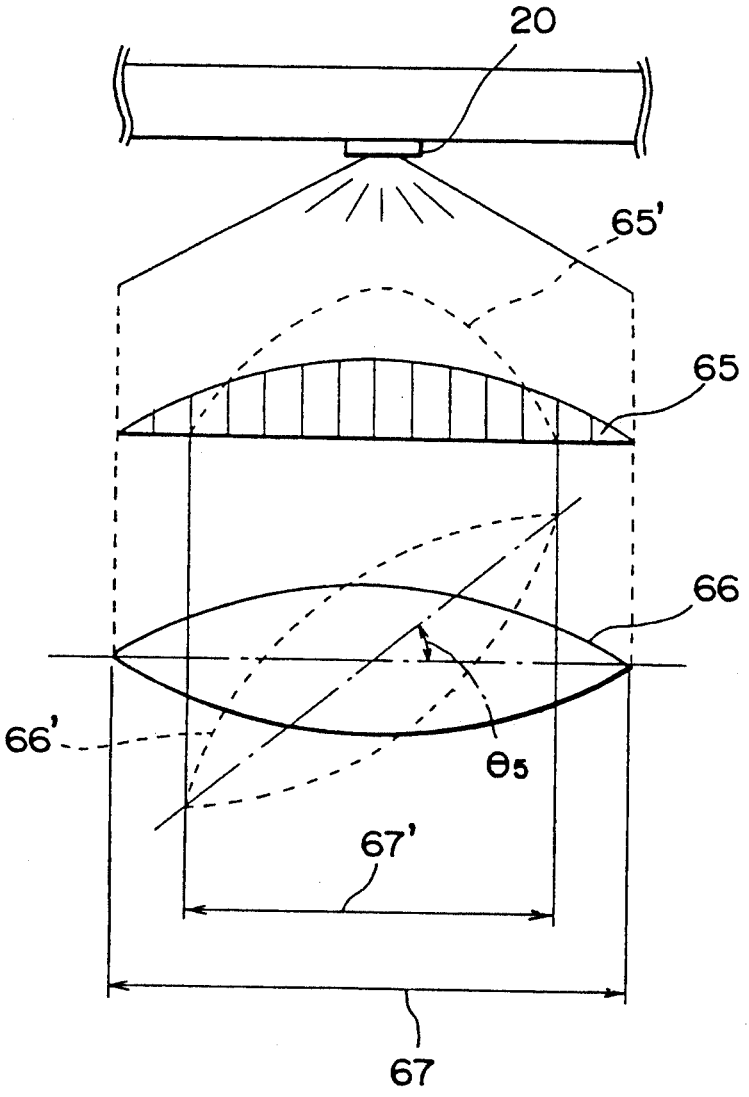
FIG. 11 is a schematic view showing the atomization distribution, atomization region, and atomization pattern obtained by the nozzle when it is mounted on the pipe as shown in FIG. 10.

As shown by a solid line in FIG. 10, when the nozzle 20 is mounted on the pipe 60 so that the axis $l_3$ of the pipe 60 coincides with the center line $l_1$ of the fan-shaped injection opening 42 in the longitudinal direction thereof, the atomization distribution 65 and the atomization region 67 are symmetrical with respect to the nozzle 20 as shown in FIG. 11. As described previously, according to the first embodiment, fluid is atomized from the nozzle 20 in the direction coinciding with the axis $l_2$ (the axis of mounting threaded portion 26) thereof. Therefore, when the nozzle 20 makes an angle of, for example, $\theta_5=45°$ with the axis of the pipe 60 as shown in FIG. 10, the atomization pattern 66′ makes an angle of $\theta_5=45°$ the atomization pattern 66 of the above case, and the atomization distribution 65′ is also symmetrical with respect to the nozzle 20 as shown in FIG. 11. Thus, the atomization region 67′ does not change greatly compared with the above-described case. That is, according to the first embodiment, it is unnecessary to mount the nozzle 20 with a high positioning accuracy, and the use of a lock nut is not required.

Figure 12:
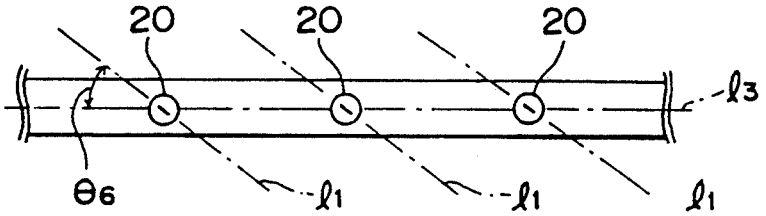
FIG. 12 is a schematic bottom view showing a plurality of the nozzles shown in FIG. 1 mounted on the pipe.
Figure 13:
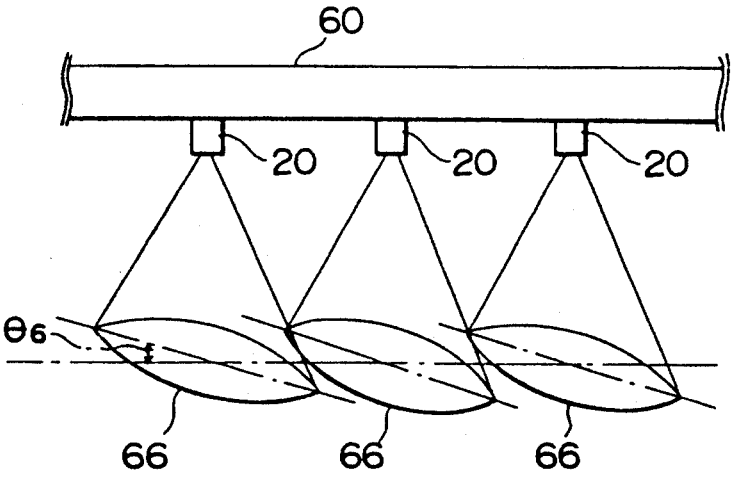
FIG. 13 is a schematic view showing atomization from the nozzles of FIG. 1 when mounted on the pipe as shown in FIG. 12.

When a plurality of the nozzles 20 is mounted on the pipe 60 so that each nozzle 20 makes an angle of $\theta_6$ with the axis $l_3$ of the pipe 60 as shown in FIG. 12, the minor axes of approximately elliptical atomization patterns 66 are adjacent one another as shown in FIG. 13. Thus, the fluid atomized from one nozzle 20 does not interfere with fluid atomized from other nozzles 20.

Figure 14:
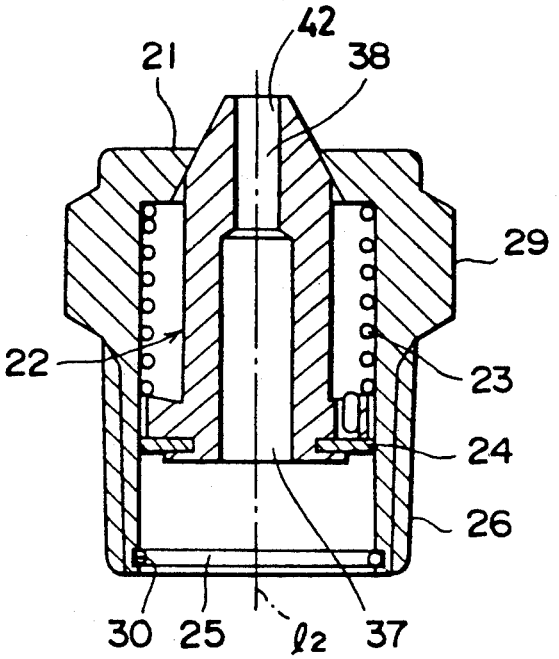
FIG. 14 is a sectional view showing a nozzle according to a second embodiment of the present invention.
Figure 15:
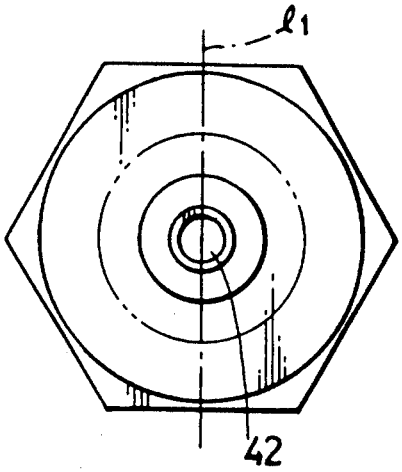
FIG. 15 is a plan view showing the nozzle of FIG. 14.
Figure 16:
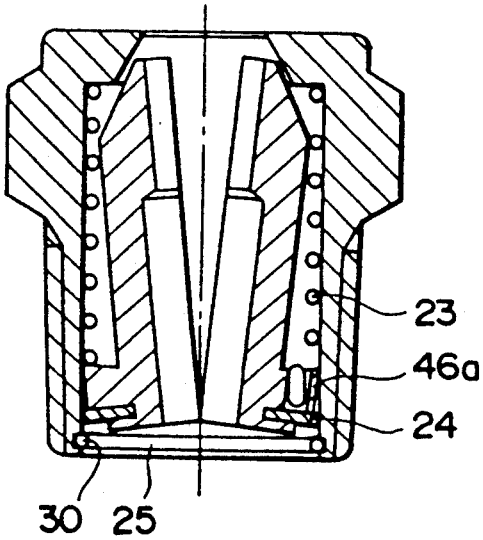
FIG. 16 is a sectional view showing the nozzle of FIG. 14 during a self-cleaning operation.

A second embodiment of the present invention is described below with reference to FIGS. 14 through 16. A notch is not formed in the forward end of the discharge section 33, i.e. no constriction is provided between the injection opening 42 and the second fluid path 38. Therefore, the atomization pattern of the second embodiment is circular as shown by a two-dot chain line in FIG. 15 and fluid is atomized in the form of a circular bar.

Figure 17:
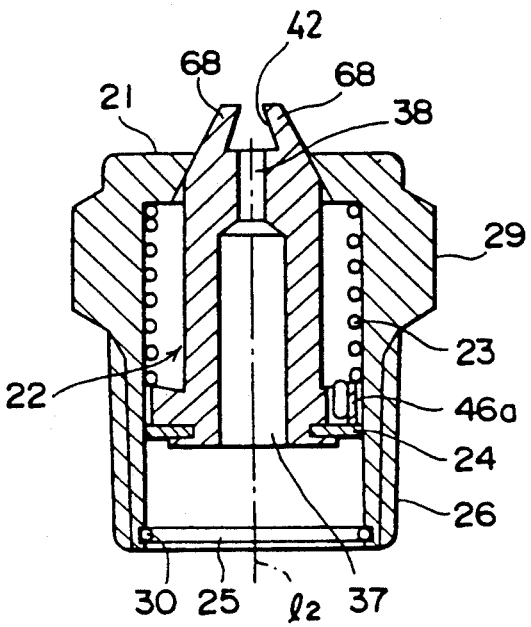
FIG. 17 is a sectional view showing a nozzle according to a third embodiment of the present invention.
Figure 18:
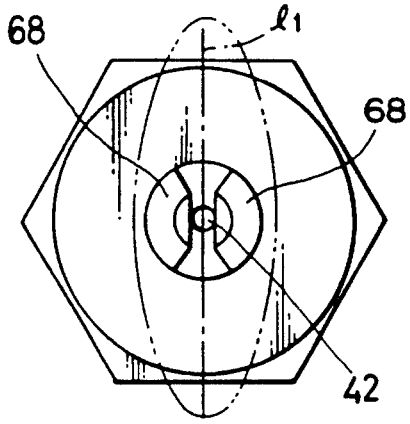
FIG. 18 is a plan view showing the nozzle of FIG. 17.
Figure 19:
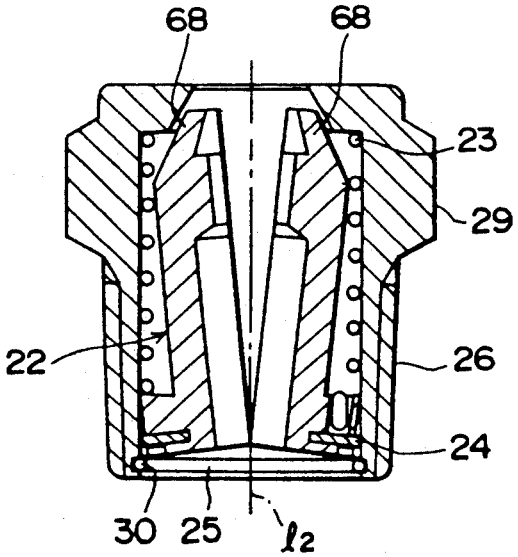
FIG. 19 is a sectional view showing the nozzle of FIG. 17 during a self-cleaning operation.

A third embodiment of the present invention is described below with reference to FIGS. 17 through 19. Similarly to the second embodiment, a notch is not formed in the forward end of the discharge section 33, i.e. no constriction is provided between the injection opening 42 and the second fluid path 38. But in the discharge section 33, a pair of inclined walls 68, which are narrowed forwardly or toward the atomization direction, are formed. Therefore, the atomization pattern of the third embodiment is as shown by a two-dot chain line in FIG. 18.

The construction of other sections and operation of the second and third embodiments are similar to those of the first embodiment. Therefore, descriptions thereof are omitted.

Various modifications of the present invention are apparent from the above description.

For example, the nozzle tip 22 consists of a pair of members 31A and 31B in the above embodiments, but may consist of three members as long as the nozzle tip 22 is axially divided.

Further, the opening 27 and the nozzle tip 22 provided in the closed section 21*a* of the nozzle main body 21 are both tapered in the above embodiments, but these can be formed such that one one of the opening 27 and the nozzle tip 22 is tapered.

Figure 20:
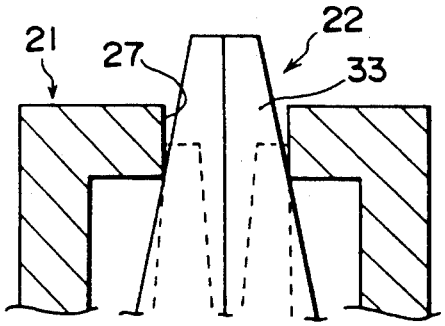
FIGS. 20 through 27 are through various schematic sectional, plan through perspective views showing modifications of the present invention.
Figure 21:
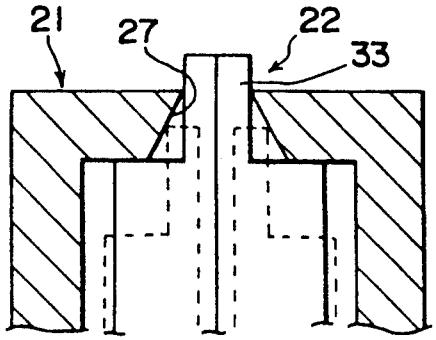

That is, the discharge section 33 can be tapered and the opening 27 can be straight as shown in FIG. 20, or the opening 27 can be tapered and the discharge section 33 can be straight as shown in FIG. 21.

The spring receiving surface 47 of the spring receiving section 34 may be flat.

Figure 22:
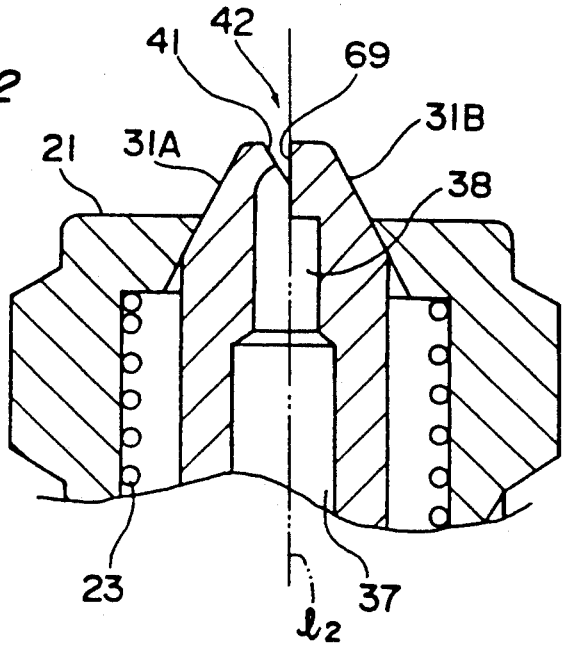
Figure 23:
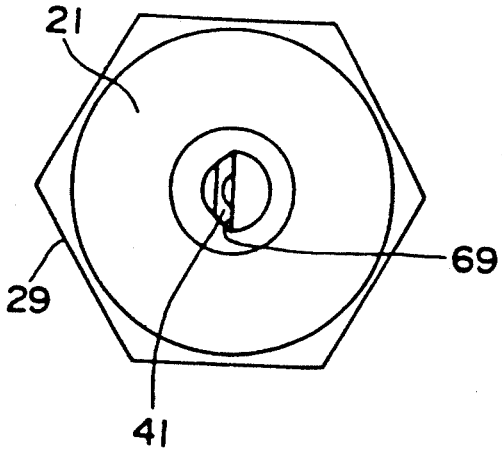

As shown in FIGS. 22 and 23, the notch 41 constituting the injection opening 42 may be formed in only the semicylindrical member 31A of the nozzle tip 22 and, in opposition to the notch 41, a flat surface 69 parallel with the axis $l_2$ may be formed on the other semicylindrical member 31B.

Figure 24:
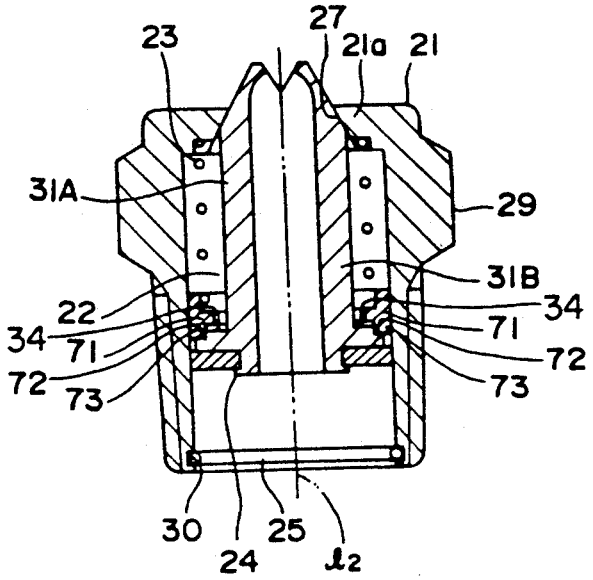
Figure 25:
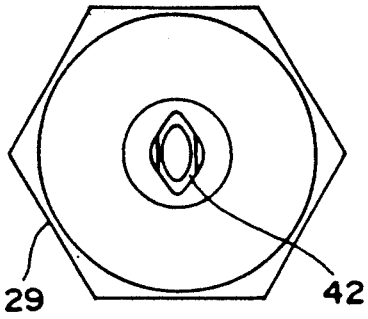
Figure 26:
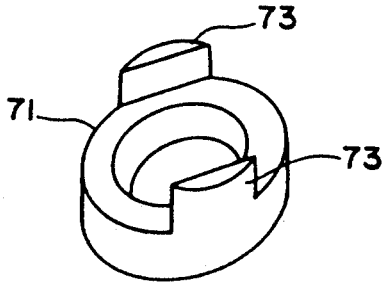

Further, as shown in FIGS. 24 through 26, a sleeve 71 may be interposed between the spring receiving section 34 and the spring 23.

That is, the construction of the above embodiment is such that the semicylindrical section 44 of the semicylindrical members 31A and 31B is perpendicular, on the discharge section side thereof, to the axis $l_2$, and cut-outs 72 and 72 formed in the periphery of the nozzle tip 22 engage a pair of opposed projections 73 and 73 formed in the lower end portion of the sleeve 71 into which the cylindrical section 32 is slidably inserted.

Figure 27:
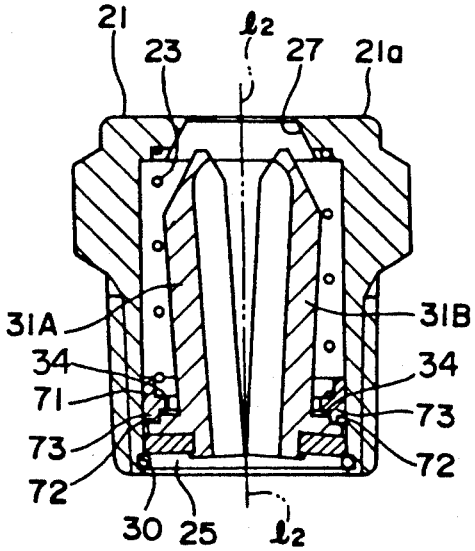
Figure 28:
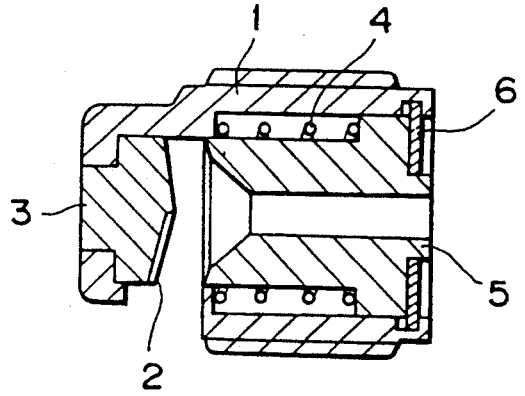
Fig. 28 (PRIOR ART)
FIGS. 28 and 29 are sectional views showing conventional nozzles.
Figure 29:
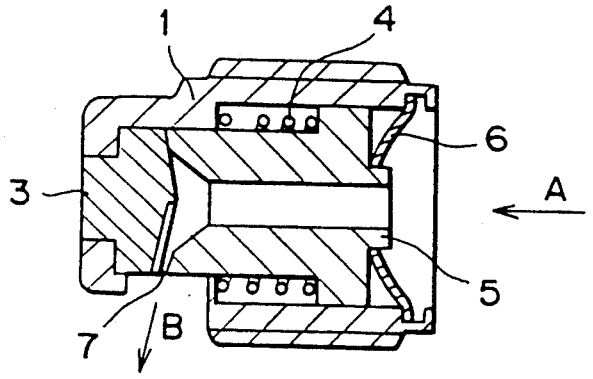
Fig. 29 (PRIOR ART)
Figure 30:
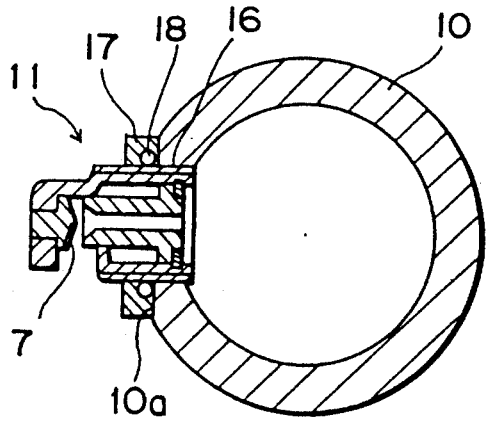
Fig. 30 (PRIOR ART)
FIG. 30 is a sectional view showing the nozzle of FIG. 28 mounted on a pipe.
Figure 31:
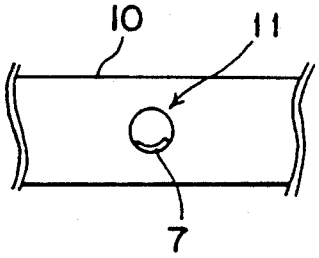
Fig. 31 (PRIOR ART)
FIGS. 31 and 32 are schematic views showing the injection opening of the nozzle of FIG. 28 point vertically downward.
Figure 34:
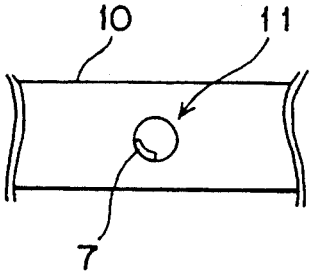
Fig. 34 (PRIOR ART)
FIGS. 34 and 35 are schematic views showing the nozzle of FIG. 28 mounted on the pipe with the injection opening of the nozzle inclined.
Figure 32:
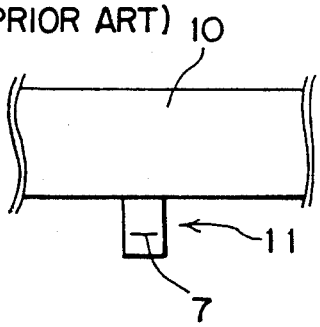
Fig. 32 (PRIOR ART)
Figure 35:
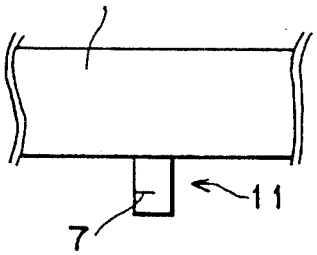
Fig. 35 (PRIOR ART)
Figure 33:
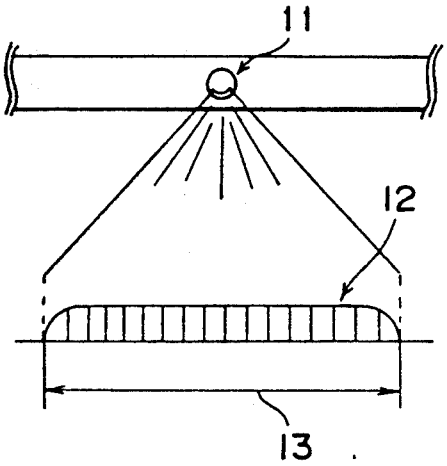
Fig. 33 (PRIOR ART)
FIG. 33 is a schematic view showing an atomization distribution and an atomization region when the nozzle is mounted on a pipe as shown in FIG. 31.
Figure 36:
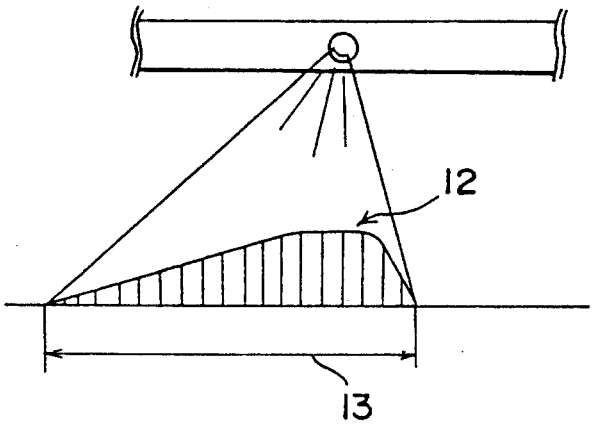
Fig. 36 (PRIOR ART)
FIG. 36 is a schematic view showing an atomization distribution and an atomization region when the nozzle is mounted on the pipe as shown in FIG. 34.
Figure 37:
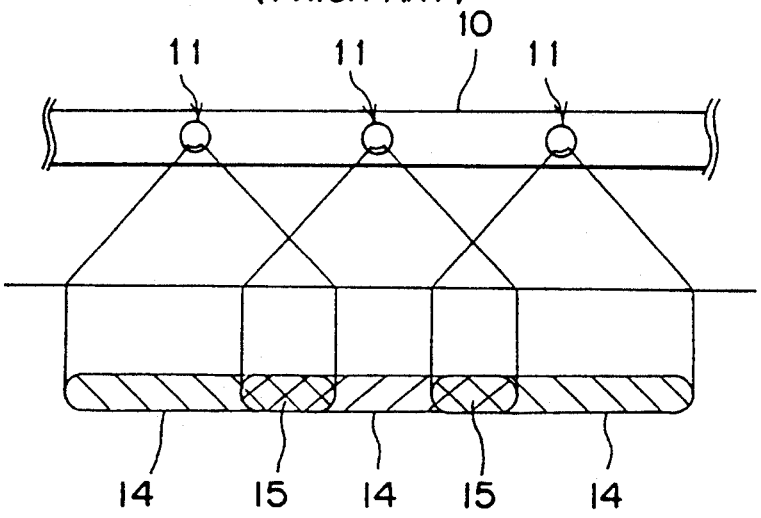
Fig. 37 (PRIOR ART)
FIG. 37 is a schematic view showing a plurality of the nozzles of FIG. 28 mounted on the pipe during an atomizing operation.

Accordingly, as shown in FIG. 27, during a self-cleaning operation, the projections 73 and 73 of the sleeve 71 urged by the spring 23 press against the semicylindrical members 31A and 31B, respectively, which constitute the nozzle tip 22. Consequently, the forward end of the nozzle tip 22 is opened.

The engagement between the cut-out 72 and the projection 73 prevents the nozzle tip 22 from rotating about the axis $l_2$ and returns the self-cleaning condition to the atomizing condition. Further, since the spring receiving section 34 of the nozzle tip 22 is pressed against by the spring 23 through the sleeve 71, the type of the spring 23 is not limited.

As described above, the diameter of the fluid path according to the self-cleaning nozzle of the present invention is greater than the diameter of the fluid path of the conventional nozzle. Therefore, foreign matter does not collect in the fluid path as much as the conventional nozzle and can be reliably discharged when the atomization pressure drops below the resilience of the spring.

Further, fluid is atomized in the axial direction of the nozzle, namely, the axial direction of the threaded portion for mounting the nozzle on a pipe. Accordingly, the atomization distribution and atomization region do not change greatly even when the nozzle is mounted on the pipe in different directions and as such, it is unnecessary to position the nozzle with high accuracy and further, the nozzle can be easily mounted on the pipe with the tapered threaded portion. This construction eliminates the use of parts, such as a lock nut normally necessary for improving nozzle positioning accuracy and an 0-ring normally necessary for preventing fluid leakage and also eliminates the need for flattening the portion on which the nozzle is mounted. As such, the nozzle of the present invention can be mounted on the pipe with fewer parts, which simplifies the operation for mounting the nozzle on the pipe.

In atomizing fluid a long distance by mounting a plurality of nozzles on the pipe, atomized fluid from one nozzle can be prevented from interfering with that from other nozzles, by mounting each nozzle on the pipe so that each nozzle makes a certain angle with the axis of the pipe.

Further, according to the present invention, fluid can be atomized in various patterns or configurations by changing the configuration of the injection opening of the nozzle tip.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A nozzle comprising:

a cylindrical nozzle main body having a rear end with a fluid inlet formed therein, and a forward end with a tip engaging opening formed therein;

a substantially cylindrical nozzle tip formed of a substantially cylindrical member divided along an axial direction thereof to form a plurality of nozzle tip members, said nozzle tip including, at a forward end thereof, a discharge section having an injection opening formed therein and, at a rearward end thereof, a radially outwardly projecting circumferential spring receiving section, nozzle tip having a fluid path extending axially therethrough and being accommodated in an interior of said nozzle main body with said discharge section being slidably engaged in said tip engaging opening such that an atomization operation is performed when fluid flows from said fluid inlet, through said fluid path, and is injected through said injection opening;

a resilient spring, interposed between said spring receiving section of said nozzle tip and a wall at said forward end of said nozzle main body, for urging said nozzle tip rearwardly when atomization pressure is reduced, in order to perform a self-cleaning operation in which foreign matter in said fluid path is discharged;

wherein said discharge section of said nozzle tip has an outer peripheral surface, said tip engaging opening has an inner peripheral surface, and at least one of said outer peripheral surface and said inner peripheral surface is tapered; and wherein a portion of said outer peripheral surface of said discharge section engages a portion of said inner peripheral surface of said tip engaging opening during said atomization operation and said self-cleaning operation.

2. A nozzle as claimed in claim 1, wherein said nozzle main body, said fluid path, said injection opening, and said nozzle tip are coaxial with one another; and a threaded portion for mounting said nozzle main body to a fluid supply pipe is formed about a periphery of said nozzle main body at said rear end thereof.

3. A nozzle as claimed in claim 2, wherein said threaded portion of said nozzle main body is tapered.

4. A nozzle as claimed in claim 1, wherein a periphery of said discharge section of said spring receiving section is tapered such that said discharge section is forced open when said nozzle tip is moved rearwardly by the resilience of said spring during the self-cleaning operation.

5. A nozzle as claimed in claim 1, wherein said inner peripheral surface of said tip engaging opening of said nozzle main body and said outer peripheral surface of said discharge section of said nozzle tip are tapered so that said discharge section of said nozzle tip engages said tip engaging opening in close contact therewith and a forward end of said discharge section projects from said forward end of said nozzle main body.

6. A nozzle as claimed in claim 1, wherein an end of said spring is fixed to said spring receiving section of said nozzle tip body, so that said spring is unrotatable.

* * * * *